US007107736B2

(12) United States Patent
Barnard

(10) Patent No.: US 7,107,736 B2
(45) Date of Patent: Sep. 19, 2006

(54) GARAGE DOOR WINDOW FRAME AND METHOD OF INSTALLATION

(75) Inventor: Ken Barnard, Ft. Worth, TX (US)

(73) Assignee: National Door Industries, Inc., Fort Worth, TX (US)

( * ) Notice: Subject to any disclaimer, the term of this patent is extended or adjusted under 35 U.S.C. 154(b) by 491 days.

(21) Appl. No.: 10/643,100

(22) Filed: Aug. 18, 2003

(65) Prior Publication Data

US 2005/0055906 A1 Mar. 17, 2005

(51) Int. Cl.
*E04G 23/00* (2006.01)

(52) U.S. Cl. ..... 52/745.15; 52/745.16; 52/745.19; 52/746.1; 52/747.1; 52/748.1; 52/656.5; 52/656.9; 52/205; 52/204.54; 52/204.597; 52/212; 52/213

(58) Field of Classification Search ..... 52/656.5, 52/656.9, 205, 717.01, 204.54, 204.597, 52/208, 455, 211–213, 475.1, 204.5, 204.55, 52/745.15, 747.1, 748.1, 745.19, 746.1, 745.16; 49/504–506

See application file for complete search history.

(56) References Cited

U.S. PATENT DOCUMENTS 4,079,529 A * 3/1978 Jennen et al. ..... 38/102.2
4,839,989 A * 6/1989 McConnell ..... 49/171
5,469,683 A * 11/1995 McKenna et al. ..... 52/730.3
5,497,588 A 3/1996 Martin et al. ..... 52/208
5,577,355 A * 11/1996 Leonelli ..... 52/204.62
5,894,706 A * 4/1999 Herbst ..... 52/782.1
6,931,810 B1 * 8/2005 Beaudoin et al. ..... 52/455
2003/0000163 A1 * 1/2003 Lamanna ..... 52/204.62
2005/0102875 A1 * 5/2005 Stravitz ..... 40/661
2005/0102877 A1 * 5/2005 Stravitz ..... 40/734
2006/0005481 A1 * 1/2006 Ouellette ..... 52/204.1

* cited by examiner

*Primary Examiner*—Jeanette Chapman
(74) *Attorney, Agent, or Firm*—Charles D. Gunter, Jr.

(57) ABSTRACT

A window frame assembly for installation within a garage door having front and rear exposed surfaces and one or more window openings. The assembly includes front and rear window frame members of injection molded plastic which are installed within the door opening on the front and rear exposed surfaces. The window frame members have engagement elements located about their peripheries which snap together in mating fashion to mount the frame members within the window opening. The engagement elements are also disenageable with a hand tool to separate the frame members and remove the members from the window opening.

5 Claims, 7 Drawing Sheets

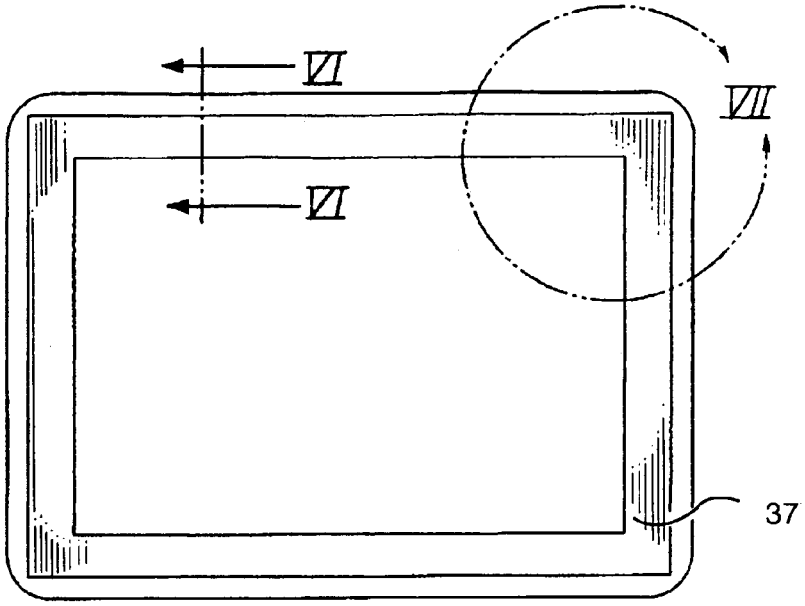
FIG. 5
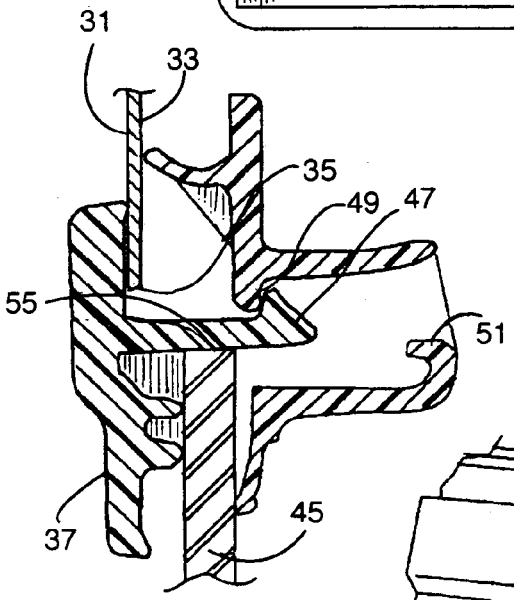
FIG. 6
FIG.7
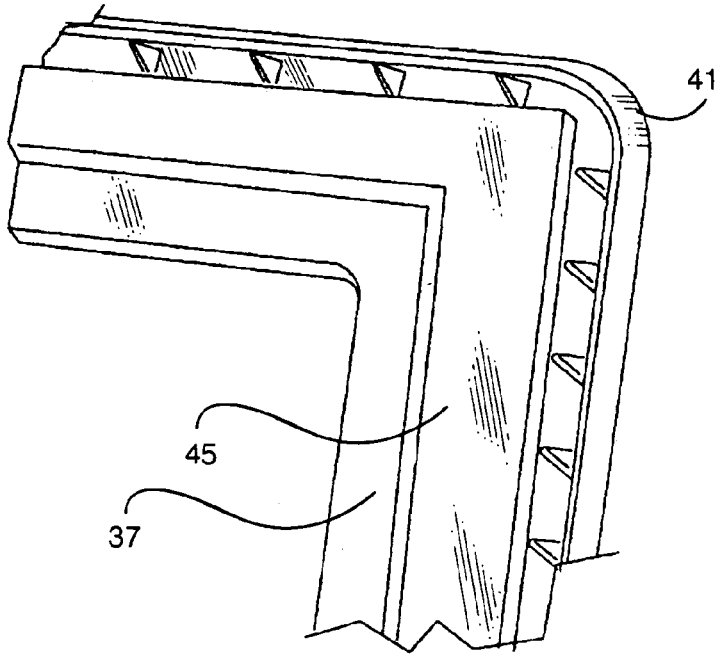

GARAGE DOOR WINDOW FRAME AND METHOD OF INSTALLATION

BACKGROUND OF THE INVENTION

A. Field of the Invention

This present invention relates to decorative molding assemblies for framing openings of residential or commercial structures, and more specifically to a decorative window frame assembly for decoratively framing a garage door window opening of a residential or commercial garage door.

B. Description of the Prior Art

Modern garage door systems are typically comprised of doors having horizontally arrayed sections joined by hinges into a door unit. The door is mounted in a vertical track which curves upwardly into a horizontal position so that the door may be opened upwardly and supported horizontally in an open position. The sections are joined by the hinges along the longitudinal edges of the sections so that the overall door structure will generally conform to the radius of curvature of the track as it changes from vertical to horizontal. Customarily, each of the sections are fabricated separately and thereafter hinged together along a longitudinal edge to provide the complete overhead door structure.

Historically, the sections are fabricated from a galvanized and/or prepainted sheet metal stock which has been rolled or otherwise formed into the particular section facing, web and parallel interior flange configurations. Vertical stiles are usually secured to the section facing and interior flanges at spaced locations by spotweld or rivet techniques. Most prior art overhead door systems use hinges that are secured directly to the section stiles. While a majority of garage doors continue to be manufactured from mild steel stock, some manufacturers offer overhead doors made from synthetic materials such as various types of vinyl.

Molding assemblies are used in a variety of applications to frame or "surround" doorways, windows, patio doors, garage doors etc., to provide a decorative, aesthetically appealing framing for the opening. In recent years, these surround molding assemblies have been manufactured from plastics and are often injection molded. In general, plastics provide significant advantages in most installations. For example, molding or framing assemblies or components thereof manufactured from plastic are low in maintenance. Plastic molding assemblies are not susceptible to moisture and therefore will not typically decay, warp or splinter. Advantageously, plastic surround molding assemblies or components thereof can be sawed, drilled, glued or nailed. Still further, during the manufacture of plastic molding assemblies, plastic can be tinted with dyes or other materials to provide molding assembly components which are of desired colors, thus obviating the need for painting prior or subsequent to installation on a structure. Molding plastics are also available as UV stable materials which are resistant to degradation upon exposure to the surrounding environment.

Particularly in the area of residential garage doors, a number of manufacturers offer plastic window frame assemblies which are fitted within openings provided in the garage door and which typically feature a central opening which contains a transparent pane which may be of glass, plastic or such newer materials as acrylics. The central opening in the window frame assembly may also contain a decorative trim member which is sandwiched between the transparent pane and other framing components.

The prior art window frame assemblies for overhead garage doors have typically been assembled in a "stick built" fashion using mounting clips. A front frame member of injection molded plastic is received into the door opening from the front side. The front frame member has a central opening for receiving the window pane, decorative trim, etc. The front frame member and pane and then retained in position by hammering four mounting clips, sometimes referred to as "stick" strips, on the back side of the door. The front frame member has an inner periphery equipped with a locking rail which matingly engages a groove in the locking strips. The locking strips have corners which are diagonally cut and fit. Once hammered into position, it was generally necessary to cut off the locking strips in order to disassemble the window frame components in order to, for example, replace the pane. Thus, while the prior art technique was generally effective in securing the window frame assembly to the door structure, the use of stick built framing techniques added to the time and expense associated with installing the complete assembly. Once installed, should one component of the surround molding assembly need to be removed or replaced, the use of such an assembly technique complicated the task of removing and replacing the subcomponents of the window frame assembly.

Accordingly, it is an object of the present invention to provide a window frame assembly for an overhead garage door which provides a decorative and aesthetically pleasing appearance, while securely supporting the various window frame components.

It is a further object to provide a versatile window frame assembly that can accommodate various other trim components that may abut the frame components.

It is yet another object of the present invention to provide a window frame assembly for a garage door which provides a decorative, aesthetically pleasing appearance, and in which the components of the window frame assembly include reversibly interlocking portions adapted to interconnect components of the assembly together. In this manner, the decorative window frame assembly can be securely, yet releasably held to the structure, while reducing the time required for assembly and without requiring the use of nails, threaded fasteners or other like fastening elements.

Accordingly, it is another object of the present invention to provide such a window frame assembly which can be secured to the structure in a secure fashion and yet which can be released and removed with the use of a simple hand tool such as a screw driver.

SUMMARY OF THE INVENTION

In view of the foregoing, it would be an advancement in the art to provide a garage door window system having a molded plastic frame which is assembled in snap-fit fashion, which can be quickly and easily disassembled, and that is characterized by the absence of mounting clips to accommodate easy replacement of the window. Such a novel garage door window system is disclosed and claimed herein.

The window frame assembly of the invention is used to install a transparent pane or a decoration trim within an opening provided in a metal, overhead garage door having front and rear exposed surfaces and at least one window opening therein. A front window frame member is formed in one piece of a synthetic, polymeric material and has a periphery sized to circumscribe the window opening from the front exposed surface of the door. A rear window frame member, also formed in one piece of a synthetic polymeric material, has a periphery sized to circumscribe the window opening from the rear exposed surface of the door. The front and rear window frame members have engagement elements located about the peripheries thereof which snap together in mating fashion to thereby mount the frame members within the window opening. The engagement elements are also disengageable with a hand tool to separate the frame members and remove the members from the window opening.

Preferably, the front and rear window frame members are injection molded from a suitable plastic and the engagement elements are tabs provided on one respective frame member for engaging aligned lips provided on the other respective frame member. For example, the tabs can be provided on a rear surface of the front window frame member and the lips can be provided on a front surface of the rear frame member. In the most preferred form of the invention, the rear frame member has openings provided therein in alignment with the engagement tabs, the openings providing access to the engagement tabs so that a hand tool can be inserted within the openings to disengage the tabs from the lips to allow the disassembly of the window frame members from within the opening in the garage door.

In the method of the invention, a window assembly is installed within a metal garage door having front and rear exposed surfaces and at least one opening provided therein. A front window frame member is formed in one piece of a synthetic, polymeric material, the front window frame member has a central opening and has a periphery sized to circumscribe the window opening from the front exposed surface of the door. A rear window frame member is also formed in one piece of a synthetic polymeric material and has a central opening and a periphery sized to circumscribe the window opening from the rear exposed surface of the door. Snap-fit engagement elements are provided about the peripheries of the front and rear window frame members which snap together in mating fashion. The front window frame member is installed within the garage door opening on the front exposed surface thereof. A transparent pane is installed within the central opening of the front window frame member. The rear window frame member is then installed on the opposite, rear exposed surface of the door opening to thereby mount the frame members within the window opening with the transparent frame being sandwiched between. The inner and outer window frame members can then be pressed together in order to engage the snap-fit engagement elements. The snap-fit engagement elements are also disenageable with a hand tool to separate the frame members and remove the members from the window opening. Since the rear frame member can be easily removed, the transparent pane can easily be repaired or replaced.

Additional objects, features and advantages will be apparent in the written description which follows.

BRIEF DESCRIPTION OF THE DRAWINGS

FIG. 5 is front, plan view of the window frame assembly of the invention.

FIG. 6 is a side, partial cross-sectional view of the front and back frame members snapped together, also showing a portion of the transparent pane and a portion of the metal door.

FIG. 7 is a view of a corner of the frame assembly from the front with the rear frame member peripheral edge being visible.

DETAILED DESCRIPTION OF THE INVENTION

As discussed briefly above, commercially available garage doors used at the present time are typically assembled from a series of door sections aligned horizontally in an edge-to-edge configuration to form a vertically oriented door for the garage opening. The sections are hinged together as a series along their abutting, horizontal edges to allow the garage door to be raised upwardly in a track to an overhead, horizontal position. The track includes a curved section between the vertical and the overhead positions. The hinged sections allow the garage door to traverse this curved section during the transition of the garage door from the vertical to the overhead, horizontal position.

Figure 1:
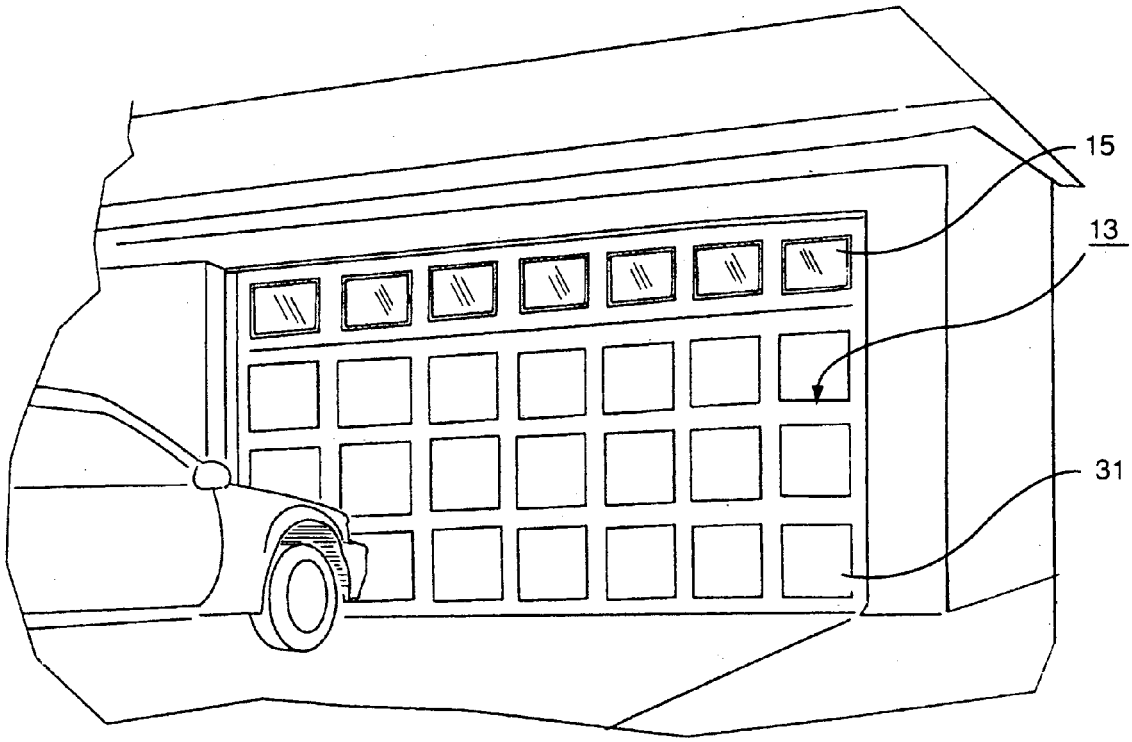
FIG. 1 is partial perspective view of a garage door having window frame assemblies of the invention installed therein.

In many of the presently available garage door systems, a series of decorative windows are incorporated the garage door, typically within an upper section of the garage door. These windows are formed in individual panels of the upper section and provide daylight illumination of the closed garage as well as a decorative appearance. A window opening is formed in each panel. Applicant's FIG. 1 shows a typical garage door 13 having window assemblies 15 installed into openings provided in a top section thereof. The garage door illustrated in FIG. 1 is shown in a simplified, stylized form for ease of illustration. Those skilled in the art will understand that such doors are typically provided, for example with a decorative surface treatment which is designed to mimic conventional wood panels while structurally imparting a certain degree of dimensional stability to garage door section.

Figure 13:
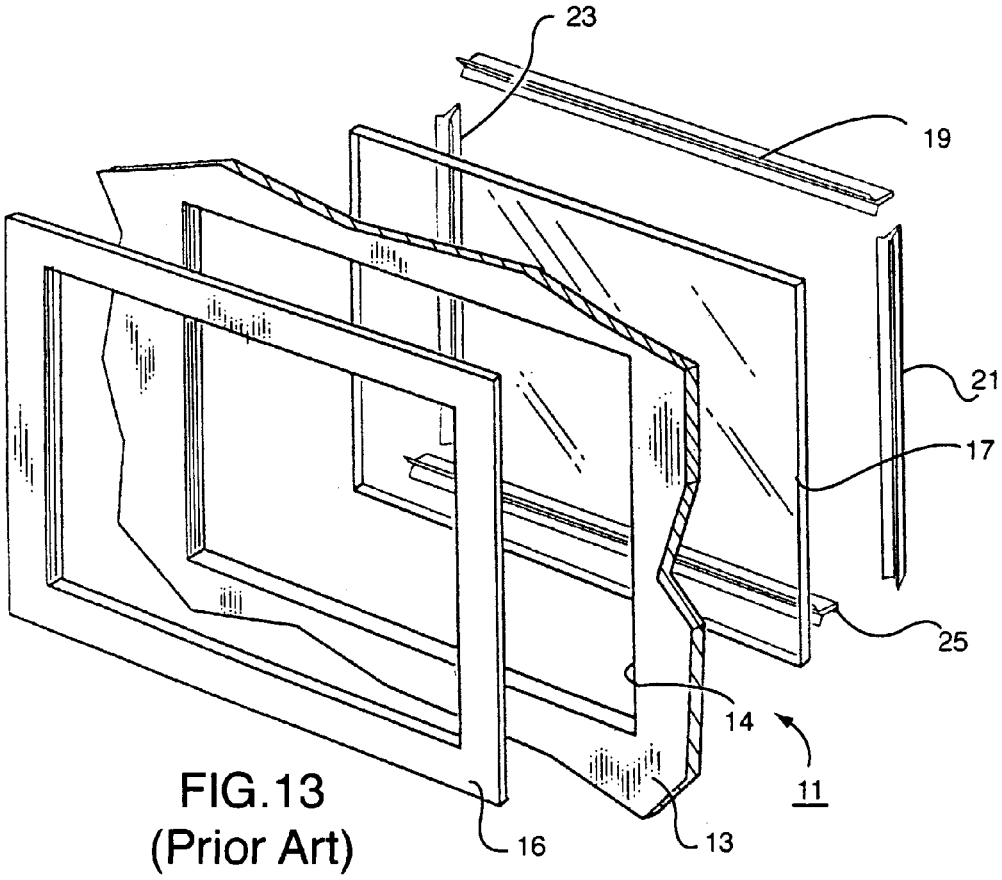
FIG.13 (Prior Art)
FIG. 13 is an exploded view of a prior art frame assembly.
Figure 14:
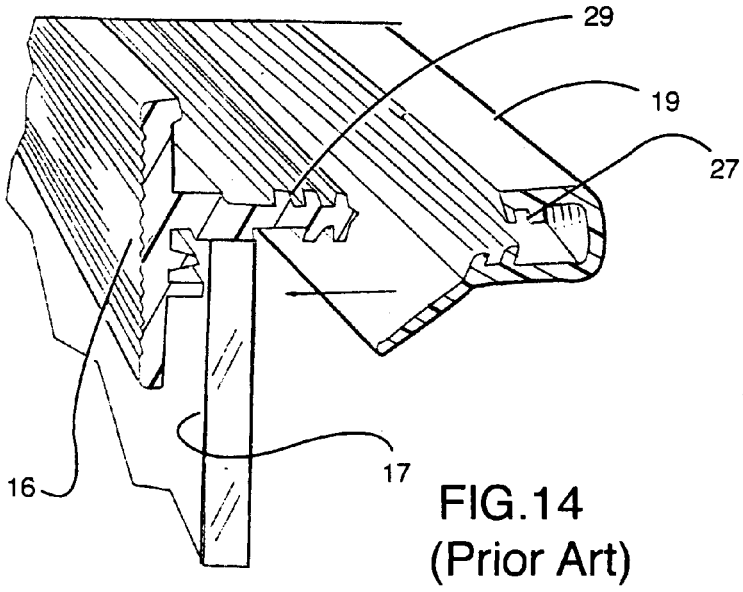
FIG.14 (Prior Art)
FIG. 14 is a partial, perspective view of the prior art frame assembly of FIG. 10 with the frame components being shown before being assembled together.
Figure 15:
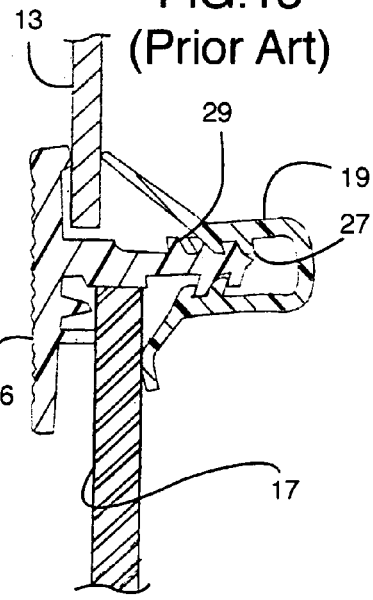
FIG.15 (Prior Art)
FIG. 15 is a view similar to FIG. 11, but with the frame components being locked together.

Conventionally, a rather cumbersome window and window framework system is inserted in the opening provided in the garage door. A typical prior art window assembly is illustrated in FIGS. 13–15 of Applicant's drawings. The window assembly, illustrated generally as 11 in FIG. 13, is shown in exploded fashion. In this illustration of prior art window 11, an exterior frame 16 is inserted into opening 14 followed by a windowpane 17 of glass or plastic. In many cases, a decorative overlay or "trim" (not shown) is mounted in the exterior frame 16. The exterior frame 16 is then mounted to garage door section 13 while the decorative overlay and windowpane 17 are retained in the exterior frame 16 by a plurality of mounting strips or clips 19, 23, 21, 25. The mounting clips 19, 21, 23, 25 are conventional devices and are configured with a generally U-shaped cross section having a series of internally located, longitudinal ridges (generally at 27 in FIGS. 14 and 15) that are designed to engage corresponding longitudinal ridges 29 on the peripheral lip of exterior frame 16. Clips 19, 21, 23, 25 are designed such that the edges of the U-shaped cross section are resiliently urged together thereby enabling the mounting clips to securely engage the longitudinal ridges 29 of the peripheral lip of exterior frame 16. This feature requires that a hammer must be used to force the mounting clips into engagement with exterior frame 16. Once engaged, the mounting clips are very difficult to remove in the event any component of prior art window frame assembly 11 requires replacement and, even if removed, experience has shown that the mounting clips 19, 21, 23, 25 are usually irreparably damaged during the removal process.

The number of components that constitute prior art window frame assembly 11 and their function result in a design that is difficult to assemble as well as to disassemble. Also, the increased costs involved with the various components along with the labor required for its assembly limit its universal application for all garage door installations. For example, it was sometimes necessary in the prior art assembly techniques to mount the window frame assembly 11 into a section of the garage door before the section was assembled into the completed garage door. The garage door section would be placed onto a padded surface and the various components of prior art window 11 would be mounted thereon. The final step of the mounting procedure required that the mounting clips be vigorously pounded into place using a heavy mallet, necessitating the use of a padded surface during the mounting procedure. An additional disadvantage of the prior art window frame design and assembly technique is that the mounting clips 19, 21, 23, 25, when viewed from the garage interior, not only sag and twist but are notoriously difficult to fit with a precision, ninety-degree fit at the abutting corners of clips, especially when the mounting clips must be vigorously hammered into place.

The combination garage door and window frame invention will now be described with respect to FIGS. 1–12. FIG. 1 shows a typical residential garage door which includes the metal overhead garage door 13 having front and rear exposed surfaces 31, 33 (FIG. 6) and at least one window opening (shown in phantom lines as 35 in FIG. 2) therein.

A front window frame 37 is preferably formed in one piece of synthetic, polymeric material and has a periphery 39 which is sized to circumscribe the window opening 35 from the front exposed surface 31 of the door 13. In the most preferred embodiment, the front window frame 37 is injection molded from a synthetic plastic such as a commercially available polyurethane or suitable polyolefin material.

Figure 3:
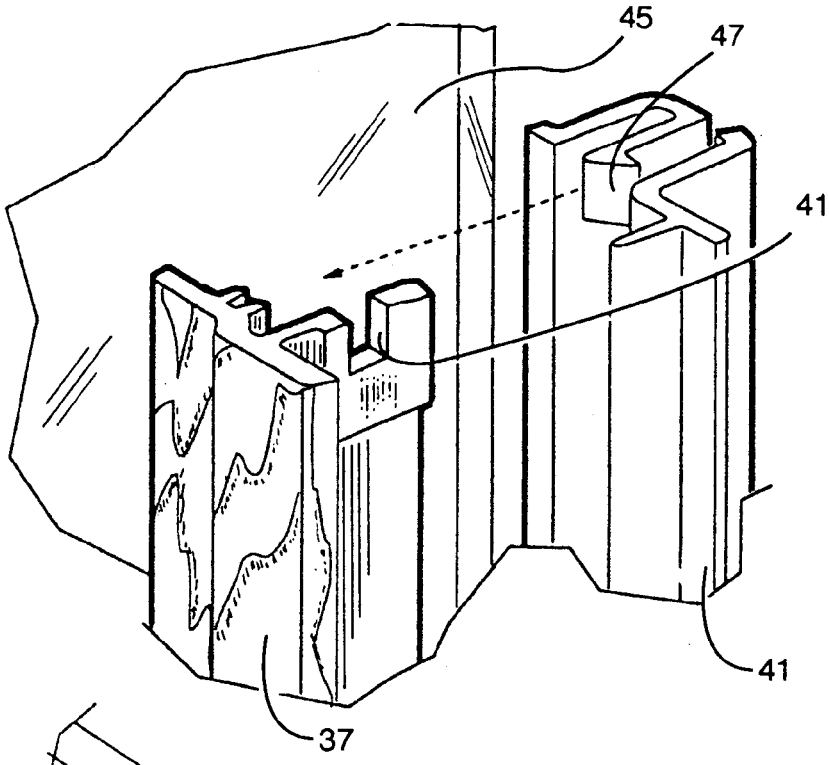
FIG. 3 is a view of portions of the front and back frame members before being snapped together.
Figure 4:
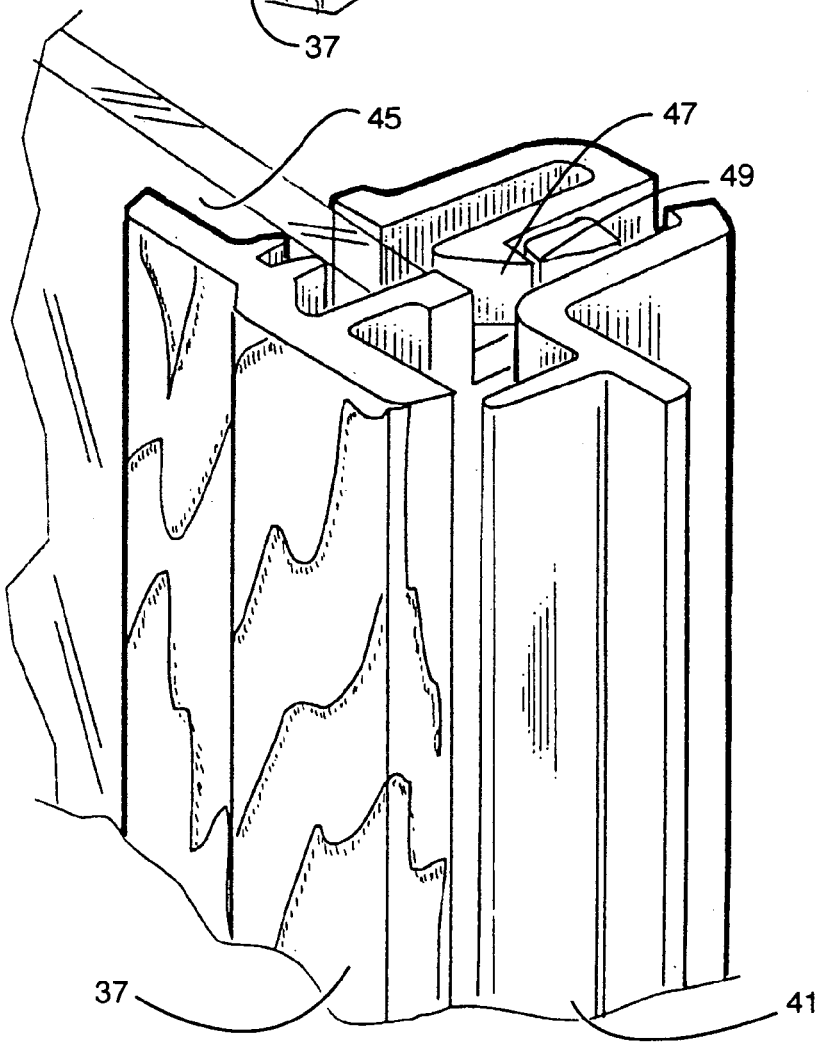
FIG. 4 is a view similar to FIG. 3, but showing the two halves of the window frame assembly snapped together.

A rear window frame member 41 is also formed in one piece of injection molded plastic and has a periphery 43 which is sized to circumscribe the window opening 35 from the rear exposed surface 33 of the door 13. The front and rear window frame members have engagement elements located at selected spaced locations about the peripheries 39, 43 thereof which snap together in mating fashion to allow the frame members to be mounted within the window opening 35. As will be explained, the engagement elements are also preferably disengageable with a hand tool, such as a screwdriver, to separate the frame members and remove the members from the window opening 35. FIG. 3 shows the front and back frame members 37, 41 prior to being snapped together and showing a transparent pane 45 retained therebetween. FIG. 4 is a similar view showing the front and back members snapped together. In a particularly preferred form of the invention, the engagement elements are tabs 47 molded in the plastic of the frame member which mate with aligned lips 49 provided on the other respective frame member. As shown in FIG. 3, the lips 49 may from a part of an engagement opening in the respective frame member. FIG. 6 is a cross-sectional view of the assembled window taken along lines VI—VI in FIG. 5 and showing the tab 47 engaging the mating lip 49 and showing the window frame assembly engaging the transparent pane 45 and being received within the opening 35 provided within the metal garage door.

Figure 12:
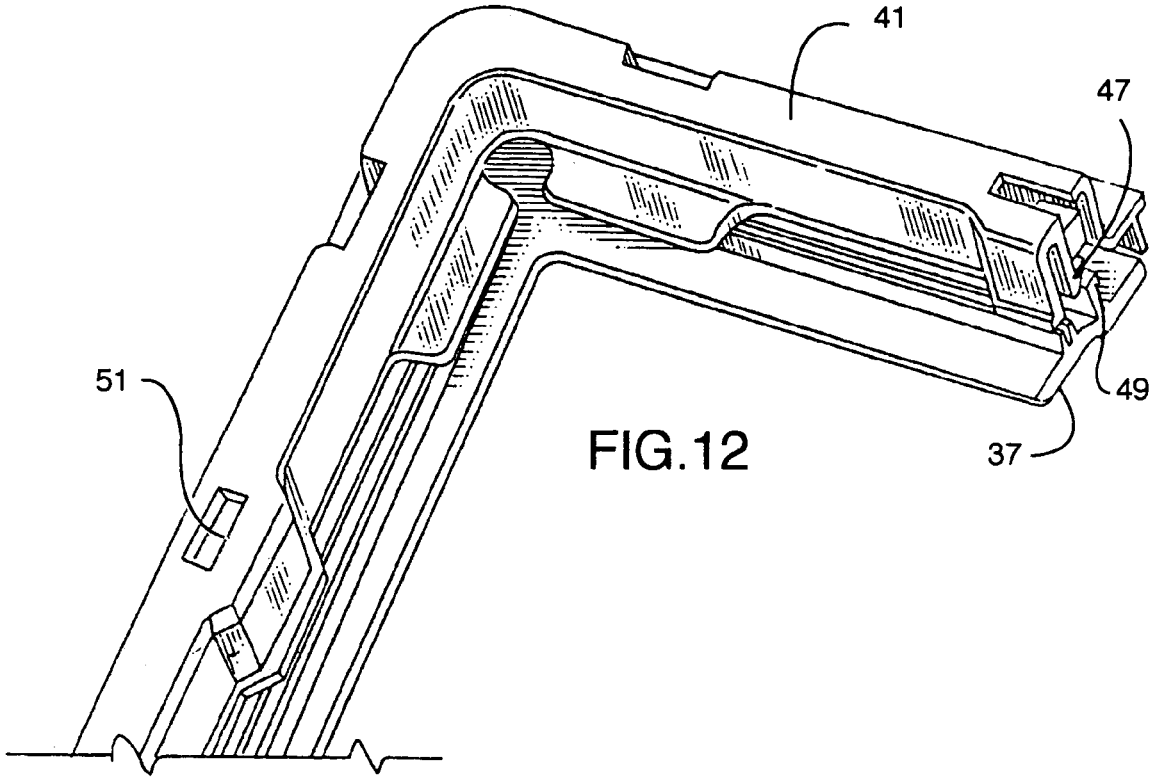
FIG. 12 is a partial, perspective view of the back side of the assembled frame showing the openings used to access the engagement elements in order to disengage the frame members and remove the back frame member.

The rear window frame member 41 has access openings 51 (FIG. 6) provided therein in alignment with the engagement tabs 47 when the frame members are assembled. The openings 51 provide access to the engagement tabs 47 so that a hand tool can be inserted within the openings 51 to disengage the tabs 47 from the lips 49 to allow the disassembly of the window frame members 37, 41 from within the opening 35 in the garage door. FIG. 12 is a view from the garage interior of a portion of the isolated frame assembly showing the access openings 51 which allow access to the locking tabs 47 in order to release the tabs from the mating lips 49.

Figure 8A:
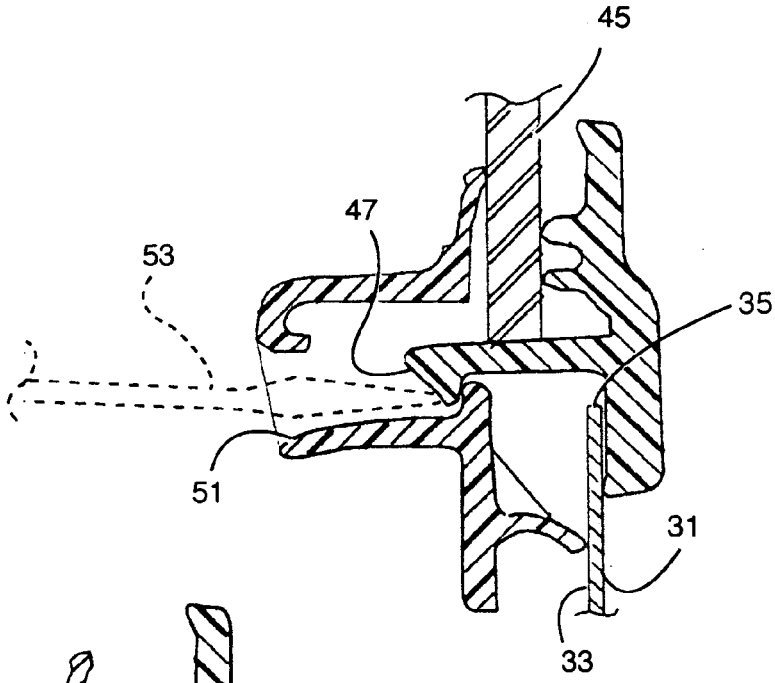
FIGS. 8A and 8B are partial cross-sectional views of the front and back frame members showing a screw driver in phantom lines being used to disengage the mating engagement elements.
Figure 8B:
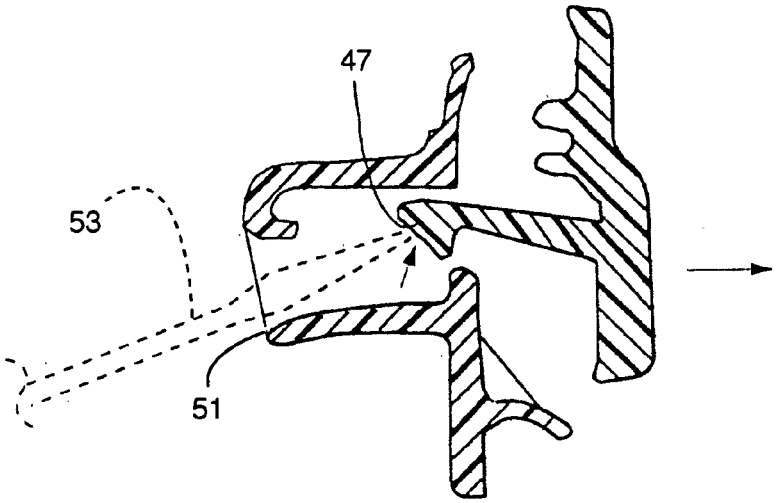

FIGS. 8A and 8B show the disassembly in which the blade of a screwdriver (indicated in phantom lines 53 in FIGS. 8A and 8B) is used to engage the tabs 47 from the within the rear access opening 51. The resilient nature of the injection molded plastic allows the tabs to be released as shown in FIG. 8B so that the frame members can be disassembled.

Figure 2:
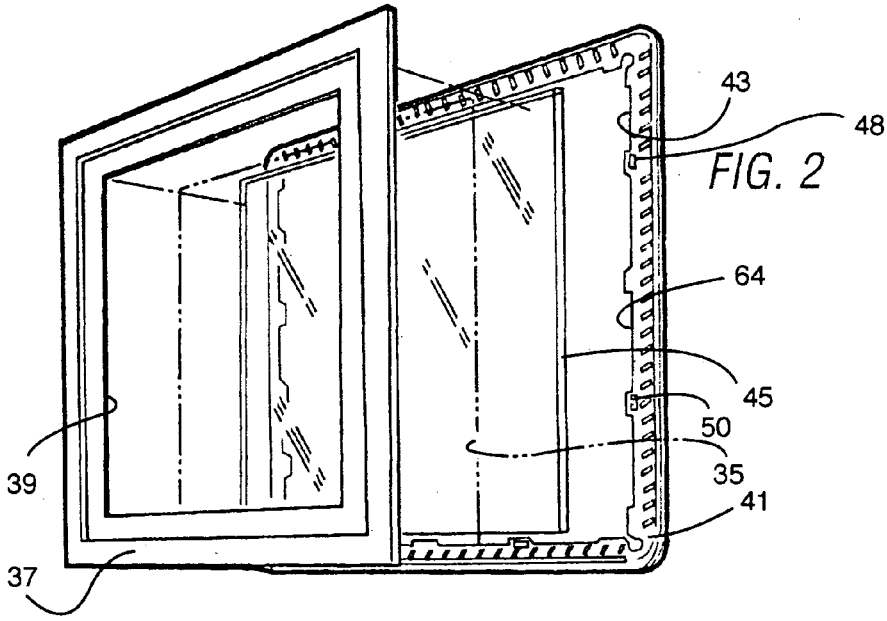
FIG. 2 is an exploded view of a window frame assembly of the invention showing the front and back frame members with a transparent pane located therebetween.

In the preferred form of the invention, the tabs 47 and lips 49 are arranged in an alternating pattern at spaced locations about the periphery of the respective window frame members. The alternating nature of the tabs and lips (see tabs 48,50) are illustrated in FIG. 2. While FIG. 2 shows only a single transparent pane installed within the window frame assembly, it will be understood that a decorative trim insert could be installed, for example, in front of the pane 45 within the frame assembly. Such decorative trim assemblies are commercially available and known in the prior art. For example, such "Design Trim" is commercially available from National Door Industries, Inc. of Fort Worth, Tex.

Figure 9:
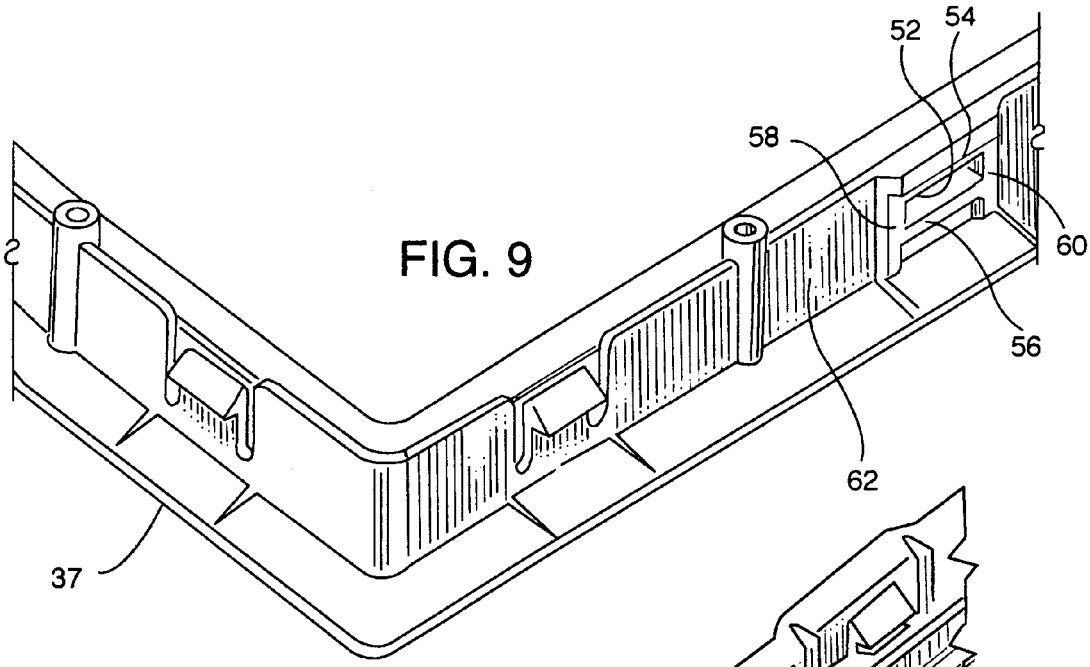
FIG. 9 is a partial perspective view of a section of the front frame member of the invention showing a field goal shaped engagement opening.
Figure 10:
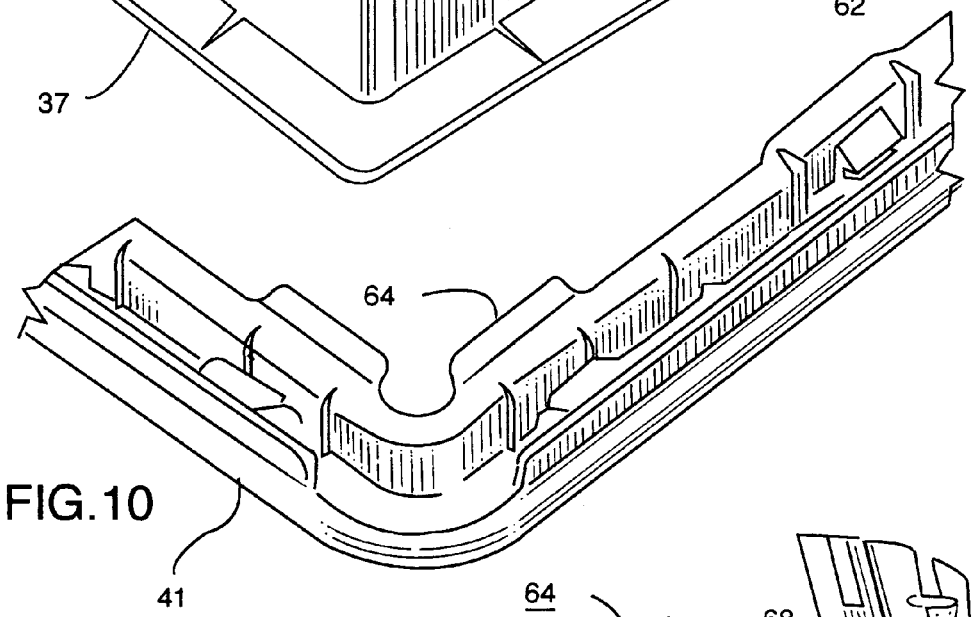
FIG. 10 is a view similar to FIG. 9 but of the back frame member showing the corresponding tab which engages the field goal shaped engagement opening of the front frame member.
Figure 11:
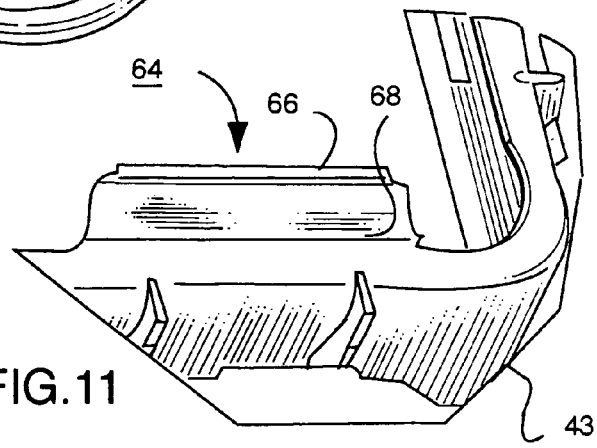
FIG. 11 is a partial perspective view of a portion of the back frame member showing the flexible hinge elements which are present at spaced circumferential locations about the periphery of the frame member.

The invention has been described with respect to locking tabs 47 and lips 49 as shown in FIGS. 3–8B. However, FIGS. 9–11 illustrate a particularly preferred from of the engagement elements of the invention. As shown in FIG. 9, the engagement opening and associated lip can take the form of a "field goal-shaped" opening 52 provided in the front frame member 37. The field goal-shaped opening 52 has reinforced top and bottom cross bar regions 54, 56 and reinforced side post regions 58,60. With reference to the plane of the periphery 62 of the front frame member 37, the cross bar regions 54, 56 and side post regions 58, 60 form outwardly extending protrusion which strengthen the wall regions of the frame member 37 at these points.

By providing the field goal-shaped openings with the reinforced cross bar and side post regions, the window frame members of the invention can withstand a 60 psf external and internal wind test. These features of Applicant's design provide a wind load capable/reversible snap fit for the front and back frame member.

FIGS. 10 and 11 show an additional feature of Applicant's invention which is the flexible hinges 64 which are located at spaced circumferential locations about the periphery of the back frame member 41. The flexible hinges 64 are planar, inwardly extending elements arranged generally parallel to the plane of the transparent pane (45 in FIG. 1) which includes trench lines 66, 68. The trench lines 66, 68 allow the hinge to flex to allow insertion of glazing materials, such as transparent pane 45, from the front side of the garage door with the frame in place. The flexible hinges also allow a pane of glazing to be removed more easily from the assembled frame.

In the method of installing a window assembly of the invention, the front frame member (37 in FIG. 2) is first installed within the garage door opening 35 on the front exposed surface 31. A transparent pane 45 and, optionally, a decorative trim insert may also be installed either in front of or behind the pane 45. The rear window frame member 41 in then installed from the opposite, rear exposed surface 33 of the door opening by simply snapping the front and rear frame members together in snap-fit fashion in order to thereby mount the frame members within the window opening with the transparent pane being sandwiched therebetween. Alternatively, the flexible hinges 64 allow a pane of glazing to be installed from the front side of the garage door even with the complete frame in place.

If it becomes necessary to disassemble the window frame assembly, for example, to repair or replace the transparent pane, the frame members 37, 41 can easily be separated by inserting the blade of the screwdriver through the openings 51 in order to disengage the tabs 47 from the lips 49. The frame members then easily snap apart and can be removed from the door opening.

An invention has been provided with several advantages. The garage door window frame assembly of the invention is simple in design and economical to manufacture using frame members from injected molded plastic. The front and rear frame members are provided with mating engagement means which allow the frame members to be engaged in snap-fit fashion by simply pressing the front and rear frame members together. It is not necessary to utilize a hammer or to assemble the frame members into a door section in a separate step as was often done in the prior art. The nature of inter-engageable tabs and lips allows the engagement members to be easily released with a simple hand tool such a screwdriver blade so that the frame assembly can be disassembled for repair or replacement.

While the invention has been shown in one of its forms, it is not thus limited and is susceptible to various changes and modifications without departing from the spirit thereof.

I claim:

1. A method of installing a window assembly within a metal garage door having front and rear exposed surfaces and at least one opening provided therein, the method comprising the steps of:

providing a front window frame member formed in one piece of a synthetic, polymeric material, the front window frame member having a central opening and having a periphery sized to circumscribe the window opening from the front exposed surface of the door;

providing a rear window frame member also formed in one piece of a synthetic polymeric material and having a central opening and a periphery sized to circumscribe the window opening from the rear exposed surface of the door;

providing snap-fit engagement elements about the peripheries of the front and rear window frame members which snap together in mating fashion by pressing the front and rear window frame members together;

providing access openings in the rear window frame member at spaced intervals about the periphery thereof in alignment with the engagement elements when the frame members are assembled;

installing the front window frame member within the garage door opening on the front exposed surface thereof;

locating a transparent pane within the central opening of the front window frame member;

installing the rear window frame member on the opposite, rear exposed surface of the door opening to thereby mount the frame members within the window opening with the transparent pane being sandwiched between;

pressing the front and rear window frame members together in order to engage the snap-fit engagement elements;

using a hand tool to disengage the snap-fit engagement elements, the hand tool being inserted into the frame access openings of the rear window frame member to disengage the engagement elements;

separating the window frame members;

removing the existing transparent pane from between the two window frame members;

installing a new transparent pane between the two window frame members; and again engaging the window frame members within the garage door opening.

2. A method of installing a window assembly within a metal garage door having front and rear exposed surfaces and at least one opening provided therein, the method comprising the steps of:

providing a front window frame member formed in one piece of a synthetic, polymeric material, the front window frame member having a central opening and having a periphery sized to circumscribe the window opening from the front exposed surface of the door;

providing a rear window frame member also formed in one piece of a synthetic polymeric material and having a central opening and a periphery sized to circumscribe the window opening from the rear exposed surface of the door;

providing snap-fit engagement elements about the peripheries of the front and rear window frame members which snap together in mating fashion;

installing the front window frame member within the garage door opening on the front exposed surface thereof;

locating a transparent pane within the central opening of the front window frame member;

installing the rear window frame member on the opposite, rear exposed surface of the door opening to thereby mount the frame members within the window opening with the transparent pane being sandwiched between;

pressing the front and rear window frame members together in order to engage the snap-fit engagement elements;

injection molding the front and rear window frame members from a suitable plastic, the engagement elements being provided as tabs located on one respective frame member for engaging aligned lips provided on the other respective frame member; and wherein tabs and lips are arranged in an alternating pattern on a rear surface of the front window frame member for engaging aligned tabs and lips provided on a front surface of the rear frame member.

3. The method of claim 2, further comprising the steps of:

providing openings on the rear frame member in alignment with the engagement tabs, the openings providing access to the engagement tabs so that a hand tool can be inserted within the openings to disengage the tabs from the lips to allow the disassembly of the window frame members from within the opening in the garage door.

4. The method of claim 2, further comprising the steps of:

installing a transparent pane in the central opening of the window frame members;

whereby the tabs provided on the respective front and rear window frame members bear against the peripheral edges of the transparent pane when the tabs are engaged with the aligned lips to further secure the pane within the window frame assembly.

5. The method of claim 4, further comprising the steps of:

installing a trim insert within the central opening provided within the window frame members in addition to the transparent pane.

* * * * *